United States Patent [19]

Werkheiser

[11] 4,422,549

[45] Dec. 27, 1983

[54] APPARATUS FOR STABILIZING LAYERS OF NEWSPAPERS ON A MOVABLE PALLET

[75] Inventor: James S. Werkheiser, Nazareth, Pa.

[73] Assignee: Harris Graphics Corporation, Melbourne, Fla.

[21] Appl. No.: 246,731

[22] Filed: Mar. 23, 1981

[51] Int. Cl.[3] ..... B65D 19/24

[52] U.S. Cl. ..... 206/386; 206/516; 206/821; 410/31; 410/32; 410/156

[58] Field of Search ..... 108/51.1; 206/322, 449, 206/516, 585, 821, 386; 410/31, 32, 33, 46, 121, 122, 155, 156; 414/42

[56] References Cited

U.S. PATENT DOCUMENTS

| | | | |
|---|---|---|---|
| 1,953,303 | 4/1934 | Kohlmann | 206/585 X |
| 3,561,769 | 2/1971 | Hammond et al. . | |
| 3,651,769 | 3/1972 | Foley . | |
| 3,682,290 | 8/1972 | Von Gal, Jr. et al. . | |
| 3,727,870 | 4/1973 | Bass . | |
| 3,776,145 | 12/1973 | Anderson et al. . | |
| 4,013,020 | 3/1977 | Schoeller | 108/51.1 |
| 4,325,481 | 4/1982 | Kortye | 206/821 X |

*Primary Examiner*—Robert B. Reeves
*Assistant Examiner*—David F. Hubbuch
*Attorney, Agent, or Firm*—Yount & Tarolli

[57] ABSTRACT

A separator sheet for disposition between layers of newspaper bundles on a movable pallet, for stabilizing the newspaper bundles as the pallet is moved. The separator sheet has a central portion and an outer portion circumscribing the central portion. The outer portion includes inclined sections extending at acute angles to, and in both directions from, the central portion. The inclined sections engage, and exert pressure against the peripheral edges of the layers of newspaper bundles both above and below the separator sheet for stabilizing the layers of newspaper bundles on the pallet. The separator sheet is preferably a unitary structure, formed of a resilient plastic material.

6 Claims, 9 Drawing Figures

APPARATUS FOR STABILIZING LAYERS OF NEWSPAPERS ON A MOVABLE PALLET

BACKGROUND

This invention relates to an apparatus for stabilizing layers of newspaper bundles on a movable pallet so that the pallet with the layers of newspaper bundles thereon can be moved without the need to first band or otherwise secure the bundles.

After they are printed, newspaper sections are stacked and bundled. The bundles are then loaded in layers onto large pallets for subsequent movement. It is not unusual for five, six, seven or more layers of newspaper bundles to be loaded onto a single movable pallet which is then moved for further handling of the newspaper bundles.

When a number of layers of newspaper bundles are loaded onto a single pallet, those layers tend to be unstable, particularly those bundles at the outer periphery of the layers. This is due in part to the fact that the newspaper bundles are not flat but rather have a generally curved bottom. Further, the bundles of newspapers do not necessarily lie flat as they are stacked in layers.

One known technique for stabilizing layers of newspaper bundles on a movable pallet has been to place relatively flat cardboard separator sheets between the layers. However, even with cardboard separator sheets, when there are a number of layers of newspaper bundles on a single pallet the bundles are still unstable enough to require binding, or some other form of securing, before the pallet can be moved.

SUMMARY OF THE INVENTION

This invention relates to an apparatus for stabilizing layers of newspaper bundles on a movable pallet in a reliable way that avoids the necessity for binding or otherwise securing the layers of newspaper bundles to the pallet.

According to the invention, a specially formed separator sheet is located between each of the layers of newspaper bundles on the pallet. The separator sheet has a central portion and an outer portion circumscribing the central portion. The outer portion includes inclined walls sections extending at acute angles to, and in both directions from, the central portion. The inclined walls engage, and exert pressure against the peripheral edges of the layers of newspaper bundles both above and below the separator sheet for stabilizing the layers of newspaper bundles on the pallet.

The separator sheet is preferably a unitary structure, formed of a resilient plastic material. The central portion preferably includes several flat planar sections disposed in a central reference plane, and the inclined walls extend in both directions from the central reference plane. Adjacent inclined walls extend in opposite directions from the central reference plane and are interconnected by side walls extending through the central reference plane. Thus, the outer portion of the separator sheet has a wave-shaped appearance. The separator sheet is preferably rectangular, and its corners are formed by converging, inclined walls extending at acute angles to the central reference plane.

In use, separator sheets according to the invention are disposed between horizontal layers of newspaper bundles loaded on a movable pallet. Each separator sheet exerts forces against the peripheral edges of the layers of newspaper bundles above and below it to resist outward movement of the newspaper bundles. Thus, the separator sheets stabilize the layers of newspaper bundles as the loaded pallet is moved. Separator sheets according to the invention have been found capable of stabilizing layers of newspaper bundles on a movable pallet to a degree which allows the pallet to be moved without first binding or otherwise securing the newspaper bundles.

BRIEF DESCRIPTION OF THE DRAWINGS

Further features and advantages of the invention will become apparent to one skilled in the art from the following detailed description of a preferred embodiment made with reference to the accompanying drawings wherein.

DETAILED DESCRIPTION OF THE PREFERRED EMBODIMENT

Figure 1:
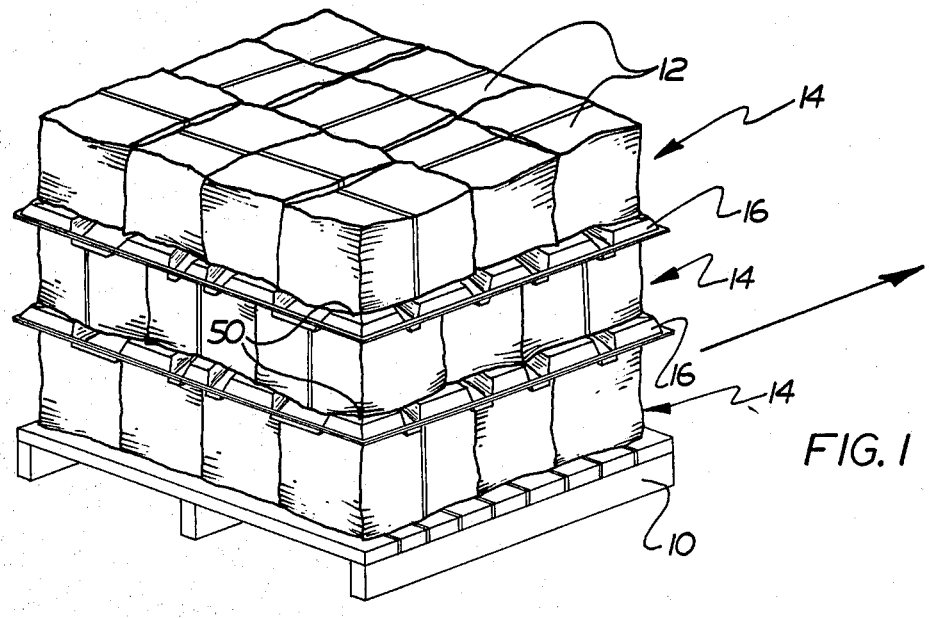
FIG. 1 is a schematic, perspective view of a movable pallet, with layers of newspaper bundles, and separator sheets according to the invention between the layers of newspaper bundles.
Figure 2:
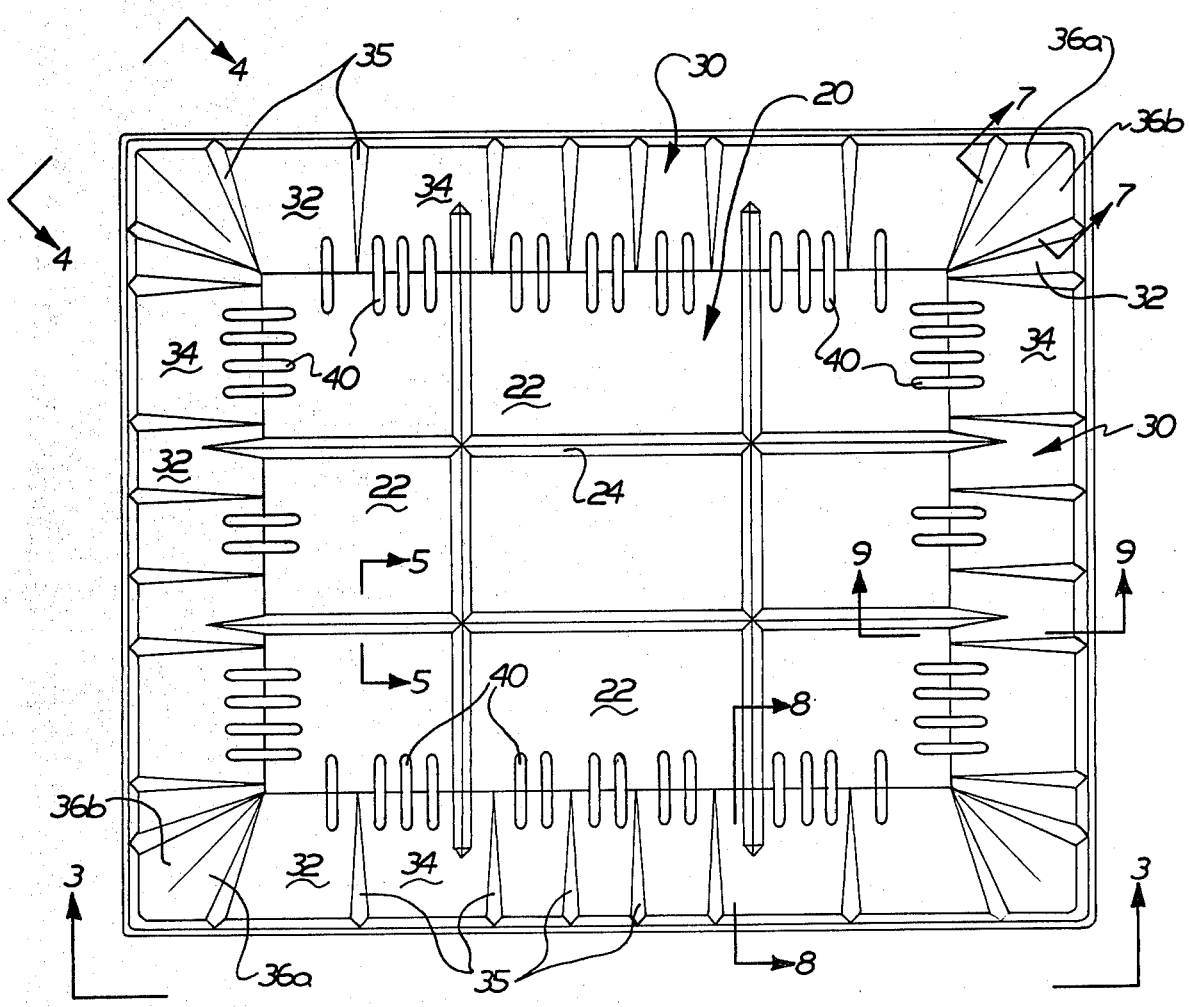
FIG. 2 is a top plan view of a separator sheet according to the invention.
Figure 3:
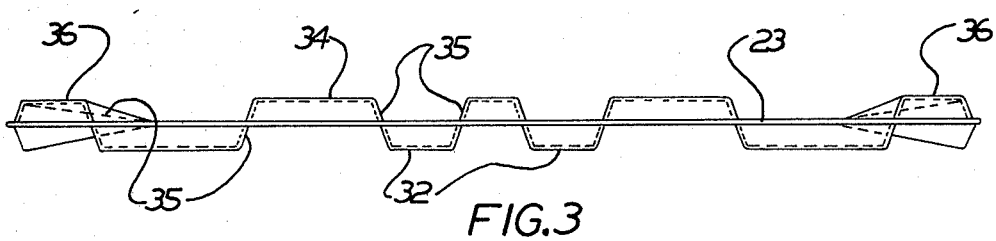
FIG. 3 is a side elevational view of the separator sheet of FIG. 2, taken from the direction 3—3.
Figure 4:
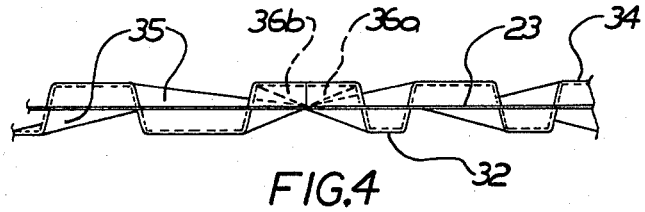
FIG. 4 is an elevational view of one corner of the separator sheet of FIG. 2, taken from the direction 4—4.

As shown in FIG. 1, a movable pallet 10 carries three horizontal layers 14 of newspaper bundles 12. Each layer 14 includes several newspaper bundles 12 formed into a generally rectangular configuration. A separator sheet 16, constructed according to the invention, is disposed between each of the layers 14 of newspaper bundles.

Preferably, the newspaper bundles 12 are formed into layers, and loaded onto the pallet along with the separator sheets 16 in accordance with a system disclosed in concurrently filed U.S. patent application Ser. No. 335,839 entitled Palletizer for Newspaper Bundles. While the system forms no part of the present invention, it is the preferred way of forming layers of newspaper bundles, and loading those layers of newspaper bundles and the separator sheets 16 onto the pallet 10.

When the pallet 10 is loaded with a number of layers of newspaper bundles it is moved for further handling the newspaper bundles. As shown schematically in FIG. 1, the newspaper bundles are not flat, rather they have generally curved configurations. Further, the bundles do not necessarily lie flat as they are stacked in layers. Previously, it has been necessary to manually bind the layers of newspaper bundles onto the pallet before the pallet is moved. The problem of newspaper bundles falling from the pallet is particularly acute when a large number of layers (e.g., 5, 6 or 7 layers) are loaded onto a single pallet.

In accordance with the present invention separator sheets 16 are located between the layers of newspaper bundles for stabilizing as many as 5, 6 or 7 layers and allowing the pallet 10 to be moved without having to bind or otherwise secure the layers of newspaper bundles onto the pallet.

Referring to FIG. 1, when the separator sheets 16 are disposed between the layers of newspaper bundles, outer portions of the separator sheets lie just outside the layers of newspaper bundles. As seen from the following description, the outer portions of the separator sheets are designed so that each separator sheet applies forces to the peripheral edges of the layers of newspaper bundles above and below it and resists horizontal outward movement of the newspaper bundles. Thus, the separator sheets help resist newspaper bundles from falling off the pallet as the pallet is moved.

Figure 5:
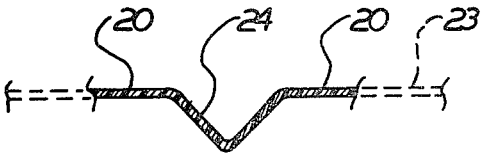

Referring now to FIGS. 2 through 7, the separator sheet 16 has a central portion 20 which is generally rectangular, and includes a series of planar, rectangular shaped sections 22. The planar sections 22 all lie in a central reference plane 23, which is shown in FIGS. 3–6. According to the preferred embodiment, the planar sections 22 are separated by V-shaped notches 24 which extend downward from the central reference plane (FIG. 5). However, it is also contemplated that the central portion 20 could simply consist of a single, planar, rectangular section, without the notches 24.

The central portion 20 of the separator sheet is circumscribed by an outer portion designated 30. The outer portion includes a series of inclined walls 32 extending downwardly from, and at acute angles to, the central reference plane 23. The outer portion 30 also includes a series of inclined walls 34 extending upwardly from, and at acute angles to, the central reference plane 23. As seen from FIGS. 2–7, adjacent inclined walls 32, 34 extend in opposite directions (i.e., upwardly or downwardly) from the central reference plane 23, and at angles of about 12° to the central reference plane. A series of side walls 35 extend through the central reference plane 23 and interconnect the inclined walls 32 with the inclined walls 34. Thus, as seen from FIGS. 3 and 4, the outer periphery of the separator sheet has a wave-like appearance.

The rectangular separator sheet 16 includes four corner sections 36. Each of the corner sections 36 includes walls **36*a*, 36*b* extending at acute angles to, and generally upward from, the central reference plane 23. Further, the walls 36*a*, 36*b* converge toward each other, as seen from FIGS. 4 and 7**.

The separator sheet 16 also preferably includes stabilizing ribs 40 extending between the inclined walls 32, 34 and the central portion 20. The stabilizing ribs 40 are on both sides of the separator sheet 16, and extend generally normal to the central reference plane 23. The stabilizing ribs 40 serve to reinforce the junction of the central portion 20 with the outer portion 30, and provide additional stabilization, though not comprising a part of the present invention.

The separator sheet 16 is a unitary structure and made of a plastic material. The separator sheet is preferably a high density polyethylene. The separator sheet can be molded, pressed or otherwise formed into the foregoing configuration. As seen from the various Figures, the junctions between portions of the separator sheet which are inclined to each other are preferably slightly rounded, rather than forming sharp corners.

Figure 9:
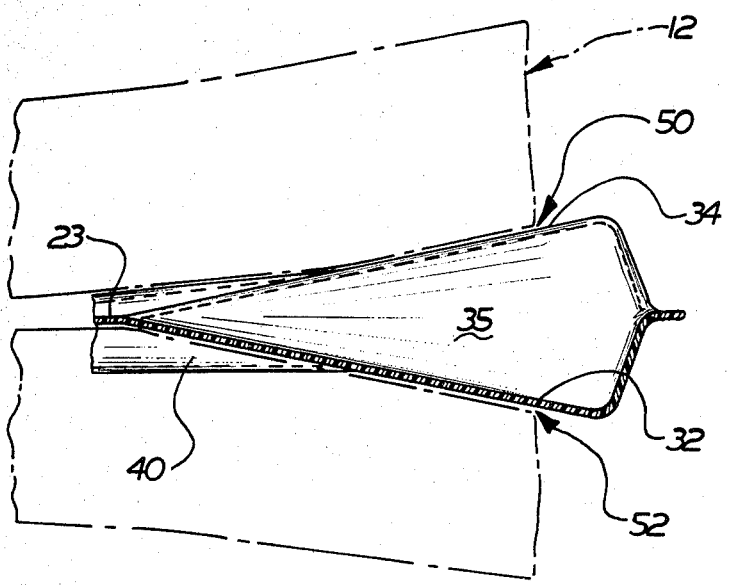
FIG. 9 is a schematic illustration of portions of some newspaper bundles above and below part of a separator sheet according to the preferred embodiment of the invention.
Figure 7:
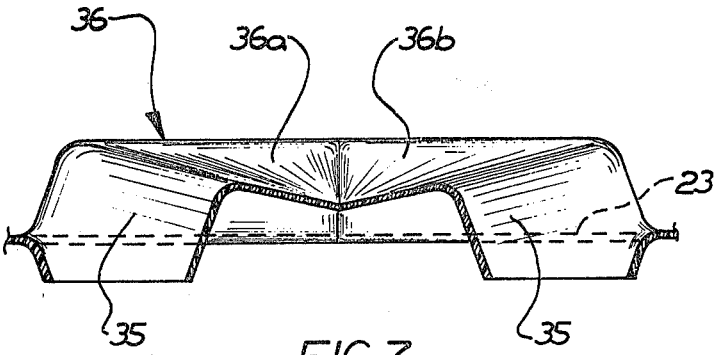
FIGS. 5, 6 and 7 are sectional views of the separator sheet of FIG. 2, taken along section lines 5—5, 6—6 and 7—7, respectively, in FIG. 2.
Figure 8:
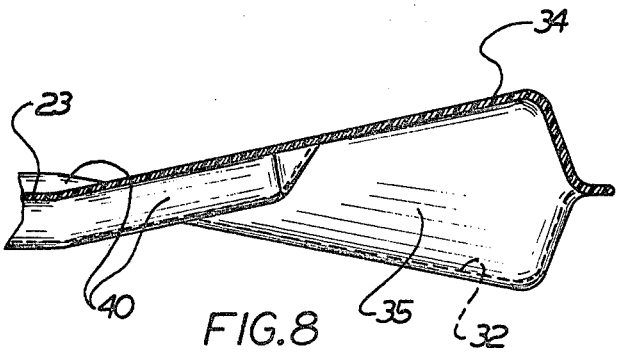
FIG. 8 is an illustration of a section of the separator sheet of FIG. 2, taken along section line 8—8, and schematically showing layers of newspaper bundles thereon.
Figure 6:
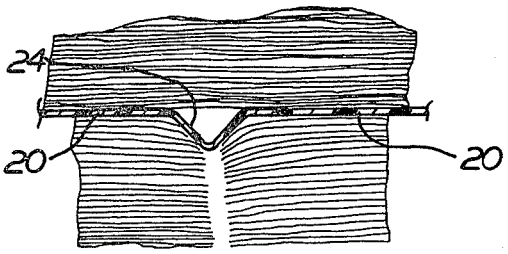

FIG. 9 schematically illustrates the effect of the inclined walls of the separator sheet 16 on the layers of newspaper bundles 12 above and below it. The upwardly inclined sections 34 engage the peripheral edges 50 of the layers of newspaper bundles 12 above the separator sheet. They exert upwardly and inwardly directed forces on the peripheral edges 50 of the newspaper bundles and may cause the newspaper bundles to tilt slightly upward, as seen in FIG. 9. Thus, they resist outward movement of the newspaper bundles above the separator sheet.

The downwardly inclined walls 32 have a similar stabilizing effect on layers of newspaper bundles below the separator sheet. They engage the peripheral edges 52 of the layer of newspaper bundles below the separator sheet and exert inwardly directed forces on the peripheral edges of the newspaper bundles. As seen from FIG. 9, they may cause the newspaper bundles below the sheet to bend slightly downward. Thus, they resist outward movement of the newspaper bundles below the separator sheet.

Thus, the upwardly inclined sections 34 and the downwardly inclined walls 32 act together to tend to hold and force the newspaper bundles into a central location relative to the pallet.

The central portion 20 helps further stabilize the layers of newspaper bundles. Those parts of the central portion 20 which lie in the central reference plane exert some frictional forces on the layers of newspaper bundles above and below the separator sheet 16 to resist movement of the newspaper bundles. Further, in the preferred embodiment the downward V-shaped notches 24 are disposed in a pattern designed to align them with the spaces between the newspaper bundles. Thus, as seen from FIG. 6, the V-shaped notches 24 can move into the spaces between the bundles of newspapers below the separator sheet to help further stabilize the layers of newspaper bundles.

What is claimed is:

1. A separator sheet for disposition between horizontally oriented layers of newspaper bundles on a movable pallet, said separator sheet having a central portion and an outer portion circumscribing the central portion, the outer portion including first inclined walls extending upwardly from the central portion at acute angles thereto and for bearing against the bottom surfaces of the outer bundles of the layer of newspaper bundles above the separator sheet to support said outer bundles of said layer of newspaper bundles and for exerting forces against the outer bundles of the layer for resisting horizontal movement of the newspaper bundles above the separator sheet, the outer portion of said separator sheet further including second inclined walls extending downwardly from the central portion at an acute angle thereto and which bear against the top surfaces of the outer bundles of the layer of newspaper bundles below the separator sheet for exerting forces against the outer bundles of the layer of newspaper bundles below the separator sheet for resisting horizontal movement of the newspaper bundles below the separator sheet, said central portion being disposed generally in a central reference plane, said first inclined walls being disposed in planes extending upwardly from the central reference plane at acute angles thereto, said second inclined walls being disposed in planes extending downwardly from the central reference plane at acute angles thereto, said first and second inclined walls being alternately disposed about the central portion of the separator sheet with adjacent first and second inclined walls extending in opposite directions from said central reference plane, and said outer portion further including side walls extending through the central reference plane and interconnecting adjacent first and second inclined walls.

2. A separator sheet as defined in claim 1 wherein said central portion is rectangular, and said outer portion includes corner sections each comprising a pair of inclined walls extending upwardly from said central reference plane and converging toward each other.

3. A separator sheet as defined in any of claims 1 or 2 comprising a unitary structure of plastic material forming said central and outer portions.

4. A separator sheet for disposition between horizontally oriented layers of newspaper bundles on a movable pallet, said separator sheet comprising a unitary structure of plastic material having a central portion and an outer portion circumscribing the central portion, the outer portion including inclined walls spaced about the entire perimeter of said central portion and extending upwardly from the central portion at acute angles thereto and which bear against the bottom surfaces of the outer bundles of the layer of newspaper bundles above the separator sheet to support said outer bundles of said layer of newspaper bundles and for exerting forces against the outer bundles of the layer for resisting horizontal movement of the bundles above the separator sheet, the outer portion of said separator sheet further including several inclined walls spaced about the central portion and extending downwardly from the central portion at acute angles thereto for engaging the peripheral edges of the layers of newspaper bundles below the separator sheet and exerting forces against those layers of newspaper bundles for resisting horizontal movement of the newspaper bundles below the separator sheet.

5. A separator sheet as defined in claim 4 wherein said central portion is disposed generally in a central reference plane, the inclined walls alternately extending upwardly and downwardly from the central reference plane at acute angles thereto and being joined to each other by side walls extending through the central reference plane.

6. A separator sheet as defined in claim 5 wherein said central portion is rectangular, and said outer portion includes corner sections each comprising a pair of inclined walls extending upwardly from said central reference plane and converging toward each other.

* * * * *